US005390387A

United States Patent [19]

Dubé, Gérald et al.

[11] Patent Number: 5,390,387

[45] Date of Patent: Feb. 21, 1995

[54] LIGHTWEIGHT SELF-PROPELLED TURF SWEEPER

[76] Inventors: Gérald Dubé, 176 Fort St-Louis, Boucherville, Québec, Canada, J4B 1R7; Michel Dubé, 2453 Chemin Val Royal, Val Morin, Québec, Canada, J0T 2R0

[21] Appl. No.: 257,635

[22] Filed: Jun. 9, 1994

[51] Int. Cl.[6] ..... E01H 1/04

[52] U.S. Cl. ..... 15/79.2; 15/83; 56/344; 56/400.11

[58] Field of Search ..... 15/79.2, 79.1, 83; 56/344, 400.11

[56] References Cited

U.S. PATENT DOCUMENTS

| | | | |
|---|---|---|---|
| 781,543 | 1/1905 | McClay . | |
| 1,168,713 | 1/1916 | Cummins . | |
| 1,674,306 | 6/1928 | Shaw . | |
| 1,801,016 | 4/1931 | MacGregor . | |
| 2,300,192 | 10/1942 | Allen . | |
| 2,705,644 | 4/1955 | Stelzer . | |
| 2,732,572 | 1/1956 | Dunham . | |
| 3,947,912 | 4/1976 | Michaels . | |
| 4,084,284 | 4/1978 | Hastings | 15/79.2 |
| 4,503,661 | 3/1985 | Potter . | |
| 4,674,143 | 6/1987 | Agergard et al. | 15/79.2 |
| 4,974,283 | 12/1990 | Holsten et al. . | |

*Primary Examiner*—Edward L. Roberts
*Attorney, Agent, or Firm*—Andrus, Sceales, Starke & Sawall

[57] ABSTRACT

Disclosed herein is a lightweight, self-propelled, hand-guided sweeping apparatus for removing debris lying on the ground, the apparatus comprising: a chassis having wheels with ground engaging flotation tires; a hopper compartment mounted pivotally on the chassis to tilt upwardly and rearwardly about the pivotal connection to dump, by gravity, its debris content; tilting structure for tilting the hopper compartment about the pivotal connection; rotary brush structure for engaging and sweeping the ground surface, the brush structure being mounted integrally, horizontally and rotatively on the hopper compartment and being open to the hopper compartment to propel the debris inside the hopper compartment as the brush structure rotates; drive structure, fixedly mounted to the chassis, for selectively driving: at least one of the wheels, the tilting structure, the rotary brush structure; control structure, mounted to the chassis, for hand-guiding sweeping apparatus and selectively operating the drive structure; wherein the tilting structure is adjustable actuated, under the direction of the control structure, for regulating the position of the hopper compartment and integrally mounted rotary brush relative to the ground surface.

10 Claims, 3 Drawing Sheets

LIGHTWEIGHT SELF-PROPELLED TURF SWEEPER

BACKGROUND OF THE INVENTION

1. Field of the Invention

The present invention relates to a lightweight, hand-guided sweeping apparatus of the type having a rotary brush for propelling debris into a hopper. The apparatus of the present invention is preferably, but not exclusively, intended for use by golf courses grounds keeping crews for efficiently removing debris from various surfaces such as greens, fairways, tees and walkways. For example, the apparatus of the present invention is well suited to efficiently remove and collect aeration core debris from greens and fairways.

2. Description of the Prior Art

In general, sweepers using a rotary cylindrical brush to propel debris into a hopper are known. For example, U.S. Pat. No. 2,732,572 discloses a manually operated ground sweeper having a rotary brush propelling debris into a rearwardly disposed hopper. As the operator pushes the ground sweeper, its wheels directly drive the rotary brush. U.S. Pat. No. 3,947,912 is another example of a manually operated street cleaning apparatus having a rotary brush collecting debris in a rear hopper which can be tilted back and emptied into a larger hopper. However, those apparatuses are not self-propelled and are not adapted to cover large areas efficiently and are generally labour intensive.

There are also known self-propelled street sweepers and vacuuming units which use rotary brushes on their undercarriage to dislodge dirt and debris to facilitate their subsequent vacuuming into a collection chamber. For example, U.S. Pat. No. 4,974,283 discloses a hand-guided self-propelled street sweeper using rotary brushes and vacuum to collect debris into a detachable hopper. Such prior art sweepers are disadvantageous in that they are quite heavy and unwieldy. If ever they were attempted to be used on a turf surface such as the greens and fairways of a golf course, such machines, because of their weight and method of operation, would greatly damage the turf firstly by leaving compacting marks and secondly by gouging the turf surface and would generally be unwieldy. Moreover, their detachable hopper would have to be repeatedly manually emptied to continue sweeping operations.

Generally, it is also known in the prior art to provide tractor accessories to collect debris from turf surfaces such as golf courses. For example, it is known in the trade to use a Cushman Core Harvester TM (distributed by Ransomes America Corporation of Minneapolis, Minn.) to collect aeration cores from greens and fairways. Such equipment consists of an inclined treadmill with one end being positioned close to the ground to collect and transport aeration cores to a rear hopper. However such equipment suffers from the disadvantages that it must operate on very smooth surfaces, it is slow, and it will not collect most flat debris such as twigs, pine needles, leaves, etc.

There is therefore a need for a self-propelled and lightweight apparatus which will efficiently remove various debris such as aeration cores, twigs, leaves, pine needles, gravel, tree bark, and discarded food or beverage packaging from many surfaces including turfs such as lawns, greens, tees, and fairways, and walkway or parking lot surfaces.

SUMMARY OF THE INVENTION

The invention provides a lightweight, self-propelled, hand-guided sweeping apparatus for removing debris lying on the ground, the apparatus comprising: a chassis having wheels with ground engaging tires; a hopper compartment mounted pivotally on the chassis to tilt upwardly and rearwardly about the pivotal connection to dump, by gravity, its debris content; tilting means for tilting the hopper compartment about the pivotal connection; rotary brush means for engaging and sweeping the ground surface, the brush means being mounted integrally, horizontally and rotatively on the hopper compartment and being open to the hopper compartment to propel the debris inside the hopper compartment as the brush means rotates; drive means, fixedly mounted to the chassis, for selectively driving: at least one of the wheels, the tilting means, the rotary brush means; control means, mounted to the chassis, for hand-guiding sweeping apparatus and selectively operating the drive means; wherein said hydraulic tilting means is adjustably tilted, under the direction of said control means, for regulating the position of said hopper compartment and integrally mounted rotary brush relative to the ground surface.

One embodiment of the invention provides a lightweight, self-propelled, hand-guided sweeping apparatus for removing debris lying on the ground, the apparatus comprising: a chassis having two front wheels and one rear wheel, each wheel having ground engaging flotation tires; a combustible fuel engine, fixedly mounted to the chassis, the engine driving a first and a second hydraulic pump; hydraulic drive means, actuated by the first hydraulic pump, for motorizing at the rear wheel; a hopper compartment mounted pivotally on the chassis to tilt upwardly and rearwardly about the pivotal connection to dump, by gravity, its debris content; hydraulic tilting means, actuated by the second hydraulic pump, for tilting the hopper compartment about the pivotal connection; rotary brush means for engaging and sweeping the ground surface, the brush means being mounted integrally, horizontally and rotatively on the hopper means and being open to the hopper compartment to propel the debris inside the hopper compartment, hydraulic rotation means, actuated by the second hydraulic pump, for rotating the rotary brush means; handle means, pivotally mounted to the chassis, for hand-guiding, turning the direction of said rear-wheel, and selectively operating the driving means; control means mounted to the chassis for selectively operating the tilting means and the rotating means; wherein said hydraulic tilting means is adjustably tilted, under the direction of said control means, for regulating the position of said hopper compartment and integrally mounted rotary brush relative to the ground surface.

The apparatus of the present invention is easily manoeuvrable and will quickly sweep-up debris into the hopper compartment in a single pass. The rotary brush can be quickly accessed for repair, adjustment or replacement by upwardly tilting said hopper compartment. Depending on the type of terrain being swept, various types of brushes could be used. For example, to sweep fine debris, a bristle brush is preferably used. While for collecting collect larger debris, a rotary cylinder having, for example, rubber fingers could be used. It is also to be understood that when used on a fairway lawn, cutting blades mounded pivotally on the rotary brush axis can be used together with a brush to dislodge dead grass or debris with the cutting blades reaching down close to the ground and the brush sweeping the debris into the hopper compartment.

In a preferred embodiment of the invention, the apparatus is three-wheeled with a single wheel with a guiding handle at the rear. Such arrangement increases the manoeuvrability of the apparatus. In a still preferred embodiment, the guiding handle can be swivelled completely out of the way towards the side of the apparatus to clear the way for upwardly and rearwardly tilting said hopper compartment.

It is to be understood that without departing from the spirit of the present invention, the novel apparatus could be easily modified by adding a seat mounted on the chassis of the apparatus so as to provide a seat for an operator during use.

Other features and advantages of the invention will become apparent to those of ordinary skill in the art upon review of the following detailed description, claims, and drawings.

DETAILED DESCRIPTION OF A PREFERRED EMBODIMENT

Turning now to the FIGS. 1–3, a preferred embodiment of the present invention will now be described for illustrative purposes only.

Figure 1:
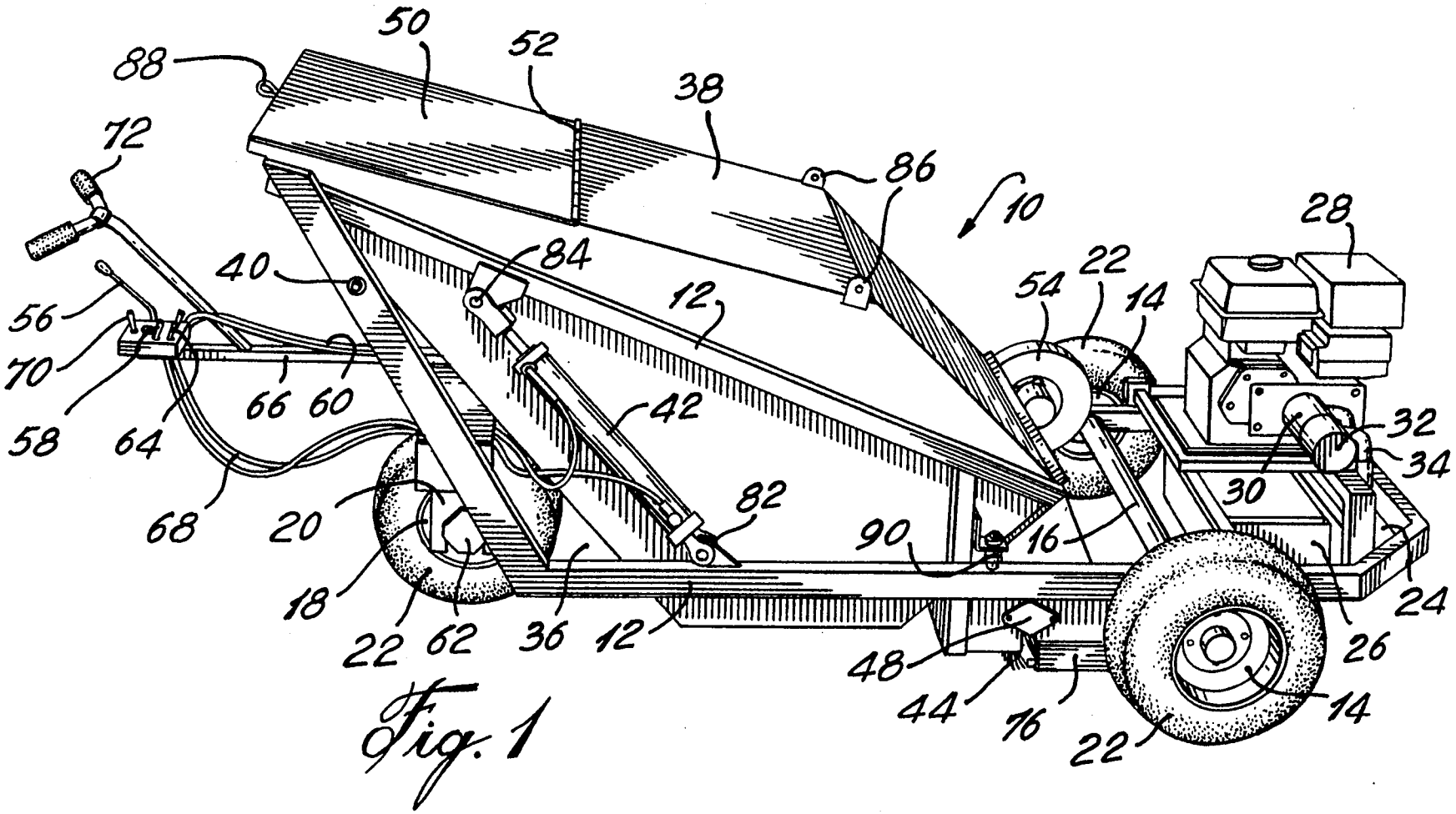
FIG. 1 is a perspective view of the apparatus of the present invention in operational position for sweeping a ground surface.
Figure 2:
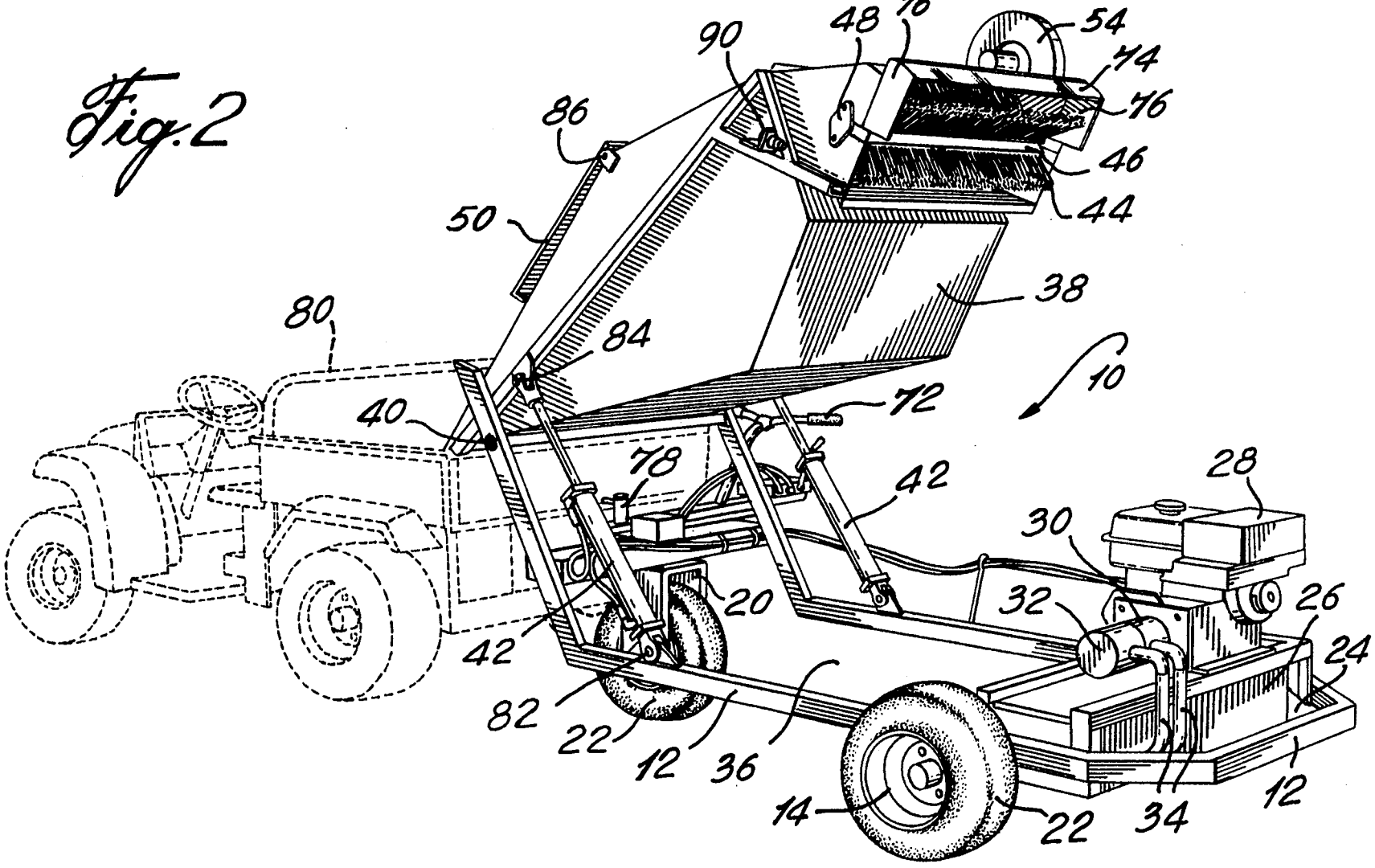
FIG. 2 is a perspective view of the apparatus of the present invention shown with its hopper compartment and integral horizontal brush tilted upwardly and rearwardly to dump its contents in a transport vehicle shown in dotted lines.
Figure 3:
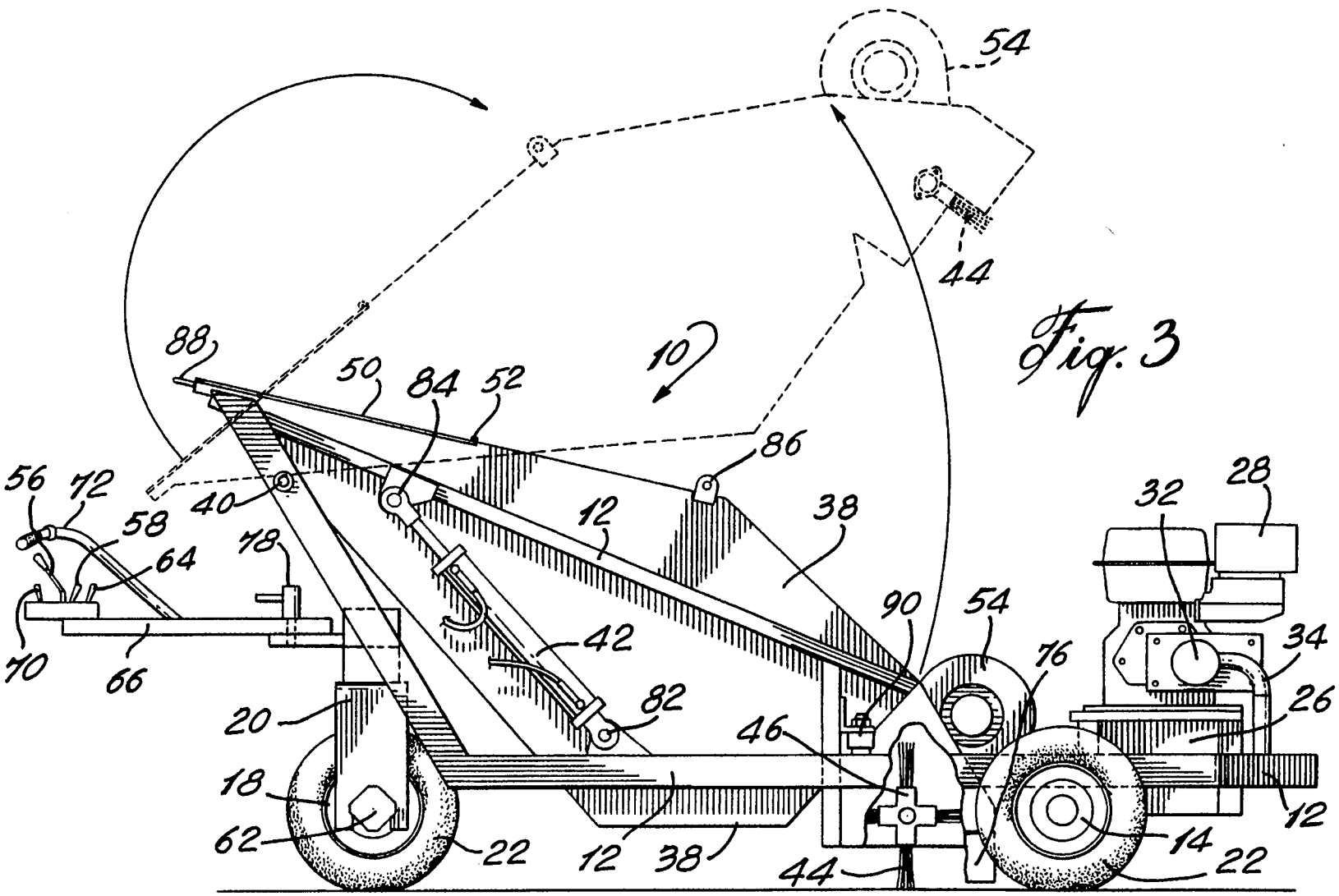
FIG. 3 is a partial cut away side view of the apparatus of FIG. 1 showing the position of the horizontal brush in relation to the ground surface.

In FIGS. 1–3 there is shown a lightweight, self-propelled sweeping apparatus generally designated 10, which includes a chassis 12. The chassis 12 is made of lightweight metal beams to provide a rigid frame assembly well known to those skilled in the art of metal fabrication and assembly. Chassis 12 is provided with a pair of coaxially mounted, front, unidirectional wheels 14 rotating about a common axle 16 and a rear multidirectional wheel 18 mounted on pivotally fork 20. Wheels 14 and 18 are conventional and provided with flotation tires 22 for minimizing compacting pressure on the ground being rolled upon.

The front portion of chassis 12 defines an open interior area generally designated 24 into which is fixedly mounted an hydraulic fluid reservoir. On top of reservoir 26 there is fixedly mounted a gasoline or other fossil fuel engine 28. Engine 28 drives two hydraulic pumps 30 and 32 connected to fluid reservoir 26 by piping 34. Hydraulic pumps 30 and 32 drive various hydraulically actuated equipment as will be further described below.

The remaining portion of chassis 12 defines an open interior area generally designated 36 into which can be positioned a hopper compartment 38. The hopper 38 is pivotally mounted to both sides of chassis 12 with pivot bolts 40. The hopper 38 is designed to be rearwardly and upwardly tilted by a pair of hydraulic cylinders 42. The front downwardly facing portion of hopper 38 is provided with a rotary cylindrical sweeping brush 44 mounted on axle 46 held on hopper 38 by fastening plates 48 removably bolted to both sides of hopper 38. The top rear portion of hopper 38 is provided with a swing door 50 which can be swung open on hinge 52. To maintain door 50 in an open position, a rod (not shown) can be slipped through aperture tabs 86 and loop 88 on door 50.

The mode of operation of this preferred embodiment of the apparatus of the present invention will now be briefly described. When engine 28 drives hydraulic pumps 30 and 32, the first pump 30 actuates hydraulic rotation motor 54 located on hopper 38. As will be easily understood by those skilled in the art of hydraulically operated equipment, hydraulic fluid hoses (not shown) connect pump 30 to rotation motor 54. The rotation of motor 54 is simply controlled by valve lever 56. Motor 54 is in rotary engagement with axle 46 which it drives at relatively high speeds which can be easily adjusted at will by those skilled in the art depending on the type of brush 44 used and the type of debris to be swept. Pump 30 also actuates, in unison, dual hydraulic cylinders 42 to tilt hopper 38 about pivot bolts 40. The tilt motion caused by hydraulic cylinders 42 is controlled by valve lever 58 located next to valve lever 56 and connected to pump 30 by hydraulic hoses 60.

Pump 32 serves to drive reversible hydraulic motor 62 on wheel fork 20. Motor 62 is controlled by adjustable valve lever 64 on guiding handle assembly 66 and is connected to pump 32 by hydraulic hoses 68. It is to be understood that since motor 62 is reversible, the advancing motion of apparatus 10 over a ground surface can be forward or reverse depending on the position of forward or reverse lever 70.

During a sweeping operation, a workman engages motor 54 by depressing lever 56 which causes the rotation of sweeping brush 44 in a direction towards the front of apparatus 10. The workman then moves lever 64 to engage the self-propelled rolling motion of wheel 22 and guide the direction of pivotally fork 20 holding wheel 22 with handle bars 72. Because of the wide freedom of movement of handle bars 72 the turning circle of self-propelled apparatus 10 is extremely small since the apparatus 10 can basically rotate about the midpoint of front axle 16.

Hopper 38 is of course provided with an opening (not shown) of dimensions similar to brush 44 to allow debris picked up by brush 44 to be propelled into hopper 38. As the workman advances over a ground surface, such as a golf course green or fairway, a lawn, a walkway, or a parking lot, debris lying thereon are swept up by brush 44 into hopper 38. To minimize scattering of debris as brush 44 rotates at high speed, front flap 74 and a pair of side flaps 76 are provided on the front facing portion of hopper 38 around brush 44.

When hopper 38 is sufficiently filled, the rolling motion of apparatus 10 is stopped by moving lever 64 and the rotation of brush 44 is stopped by moving lever 56. Prior to tilting hopper 38 to empty its debris contents, guiding handle assembly 66 is released from a locking relationship with fork 20 and is swivelled out of the way and locked again at approximately a 90° angle to its original position by manually operating lock pin device 78 shown on FIG. 3. This provides the proper clearance for tilting hopper 38. Furthermore, when handle assembly is swivelled out of the way, guiding handle assembly 66 may still be used for moving apparatus 10 sufficiently near a dumping location or another vehicle 80 shown in dotted lines on FIG. 2. The rearwardly and upwardly tilting motion of hopper 38 is simply accomplished by actuating the pair of hydraulic cylinders 42 which are pivotally mounted to chassis 12 at a pair of pivot points 82 and to the hopper at a pair of pivot points 84. Because of its shape, hopper 38 as it is tilted will gradually discharge is debris contents when door 50 is held open with a rod (not shown) slipped through apertures 86 and loop 88. Once the debris are dumped, door 50 can be closed and hopper 38 can be lowered to its rest position on frame 12 to resume sweeping.

It is to be understood that the position of hopper 38 and integrally mounted brush 44 relative to frame 12 can be easily adjusted by inserting or removing spacer bushings (not shown in detail) from resting feet 90. As spacer bushings are removed, brush 44 will become closer to the ground. In this way, workmen will quickly adjust the ride height of brush 44 to suit the particular terrain being swept or the type of brush 44 used.

It is further to be understood that brush 44 can be quickly made accessible for repair or replacement by upwardly tilting hopper 38. Also, depending on the type of terrain being swept, various types of brushes and/or debris dislodging devices such as flying cutters could be chosen to optimize the operation of the apparatus of the present invention. For example, to sweep fine debris, a bristle brush is preferably used. While for collecting larger debris such as aeration cores from golf courses, a rotary cylinder having, for example, rubber fingers could be used.

Although the invention has been described above with respect with one specific form, it will be evident to a person skilled in the art that it may be modified and refined in various ways. It is therefore wished to have it understood that the present invention should not be limited in scope, except by the terms of the following claims.

The embodiments of the invention in which an exclusive property or privilege is claimed are defined as follows:

1. A lightweight, self-propelled, hand-guided sweeping apparatus for removing debris lying on the ground, said apparatus comprising:

a chassis having wheels with ground engaging tires;

a hopper compartment mounted pivotally on said chassis to tilt upwardly and rearwardly about said pivotal connection to dump, by gravity, its debris content;

tilting means for tilting said hopper compartment about said pivotal connection;

rotary brush means for engaging and sweeping said ground surface, said brush means being mounted integrally, horizontally and rotatively on said hopper compartment and being open to said hopper compartment to propel said debris inside said hopper compartment as said brush means rotates;

drive means, fixedly mounted to said chassis, for selectively driving:

at least one of said wheels, said tilting means, said rotary brush means;

control means, mounted to said chassis, for hand-guiding the sweeping apparatus and selectively operating said drive means;

adjusting means, for regulating the tilting position of said hopper compartment and integrally mounted rotary brush relative to the ground surface.

2. The apparatus of claim 1 wherein said drive means comprises a combustible fuel engine connected to at least one hydraulic pump in turn connected to hydraulic means for selectively driving:

at least one of said wheels, said tilting means, said rotary brush means.

3. The apparatus of claim 2 wherein said drive means comprises a first and a second hydraulic pump wherein said first hydraulic pump selectively drives at least one of said wheels and said second hydraulic pump selectively drives said tilting means and said rotary brush means.

4. The apparatus of claim 2 wherein said chassis has three wheels.

5. The apparatus of claim 4 wherein said chassis has two coaxial front wheels and a turnable rear wheel pivotally mounted to said chassis and fixedly connected to said control means wherein the orientation of said rear wheel can be hand-guided.

6. The apparatus of claim 5 wherein said control means comprises a handle for hand-guiding the direction of said rear wheel and a control device for regulating the rotational speed of said wheel.

7. The apparatus of claim 2 wherein said tilting means consists of at least one hydraulic cylinder fixedly mounted at one end to said chassis and at the other end to said hopper compartment.

8. The apparatus of claim 1 wherein said tires are flotation tires.

9. The apparatus of claim 1 wherein said chassis additionally comprises a seat for seating an operator.

10. A lightweight, self-propelled, hand-guided sweeping apparatus for removing debris lying on the ground, said apparatus comprising:

a chassis having two front wheels and one rear wheel, each wheel having ground engaging flotation tires;

a combustible fuel engine, fixedly mounted to said chassis, said engine driving a first and a second hydraulic pump;

hydraulic drive means, actuated by said first hydraulic pump, for motorizing at said rear wheel;

a hopper compartment mounted pivotally on said chassis to tilt upwardly and rearwardly about said pivotal connection to dump, by gravity, its debris content;

hydraulic tilting means, actuated by said second hydraulic pump, for tilting said hopper compartment about said pivotal connection;

rotary brush means for engaging and sweeping said ground surface, said brush means being mounted integrally, horizontally and rotatively on said hopper means and being open to said hopper compartment to propel said debris inside said hopper compartment, hydraulic rotation means, actuated by said second hydraulic pump, for rotating said rotary brush means;

handle means, pivotally mounted to said chassis, for hand-guiding and turning the direction of said rear wheel and selectively operating said driving means;

control means mounted to said chassis for selectively operating said tilting means and said rotating means;

wherein said hydraulic tilting means is adjustably tilted, under the direction of said control means, for regulating the position of said hopper compartment and integrally mounted rotary brush relative to the ground surface.

* * * * *